United States Patent [19]

Rose

[11] 4,382,066

[45] May 3, 1983

[54] URANIUM EXTRACTION PROCESS

[75] Inventor: Mark A. Rose, Brierley Hill, England

[73] Assignee: Albright & Wilson Limited, Warley, England

[21] Appl. No.: 82,574

[22] Filed: Oct. 9, 1979

[30] Foreign Application Priority Data

Oct. 10, 1978 [GB] United Kingdom ..... 40066/78

[51] Int. Cl.[3] ..... C01G 43/00

[52] U.S. Cl. ..... 423/10; 423/8

[58] Field of Search ..... 423/10, 8, 6

[56] References Cited

U.S. PATENT DOCUMENTS

| | | | |
|---|---|---|---|
| 2,859,094 | 11/1958 | Schmitt et al. | 423/10 |
| 2,882,123 | 4/1959 | Long | 423/10 |
| 2,926,992 | 3/1960 | Stedman | 423/18 |
| 2,958,573 | 11/1960 | Gustison et al. | 423/10 |
| 3,243,257 | 3/1966 | Coleman | 423/10 |
| 3,288,568 | 11/1966 | Tomijima et al. | 23/319 |
| 3,711,591 | 1/1973 | Hurst et al. | 423/10 |
| 3,737,513 | 6/1973 | Wiewiorowski et al. | 423/8 |
| 3,835,214 | 9/1974 | Hurst et al. | 423/10 |
| 3,836,476 | 9/1974 | Baldwin et al. | 252/301.1 R |
| 3,966,872 | 6/1976 | Sundar et al. | 423/10 |
| 4,105,741 | 8/1978 | Wiewiorowski et al. | 423/10 |
| 4,243,637 | 1/1981 | Bradford et al. | 423/10 |
| 4,323,540 | 4/1982 | Sundar | 423/10 |

FOREIGN PATENT DOCUMENTS

| | | |
|---|---|---|
| 35412/68 | 9/1969 | Australia . |
| 1436113 | 5/1976 | United Kingdom . |
| 1474529 | 5/1977 | United Kingdom . |

OTHER PUBLICATIONS

Hurst et al., *Ind. Eng. Chem. Process Des. Dev.,* 11, (#1), pp. 122–126, 1972.

Blake et al., *Industrial & Eng. Chem.,* 50, (#12), pp. 1763–1767, 1958.

Hurst et al., *Chem. Eng.,* Jan. 3, 1977, pp. 56–57.

Hurst et al., *Ind. Eng. Chem. Process Des. Dev.,* 13, (#3), pp. 286–291, 1974.

Hurst et al., "Solvent Extraction of Uranium from Wet Process Phosphoric Acid", ORNL TM 2522, 45 pp., (Apr. 1969), Oakridge, Tenn.

*Primary Examiner*—Edward A. Miller

*Attorney, Agent, or Firm*—Frishauf, Holtz, Goodman & Woodward

[57] ABSTRACT

Uranium is extracted from wet process phosphoric acid by extraction with a mixture of a diorganophosphate and a neutral phosphorus compound, which is preferably a triorgano phosphine oxide, in the presence of nitrate to form an organic extract layer containing uranium and an aqueous acid layer, which are separated.

19 Claims, No Drawings

URANIUM EXTRACTION PROCESS

This invention relates to a process for the recovery of uranium from crude phosphoric acids.

Wet phosphoric acid made from contact of phosphate rock and sulphuric acid contains many metallic impurities, among which is uranium. Processes are known for the recovery of this uranium by extraction of the uranium with a water immiscible organic solvent containing an extractant. Among such processes is the use as the extractant of a mixture of diethylhexyl phosphoric acid (DEHPA) and trioctylphosphine oxide (TOPO), or DEHPA and tributyl phosphate. These processes are of limited application as the amount of the uranium extracted is only acceptable commercially for aqueous phosphoric acids containing 30% $P_2O_5$ (by weight) or less. Thus these processes are unsuitable for extracting uranium from the more concentrated acids.

We have found that addition of nitrate to wet process acids enables the amount of uranium extracted by such solvent mixtures to be increased.

The present invention provides a process for extracting uranium from a crude wet process phosphoric acid containing uranium, which process comprises treating the crude acid, which contains 35–60% e.g. 35–56% by weight of $P_2O_5$ and uranium at least some of which is in the hexavalent state, with a solution in an inert non polar water-immiscible organic solvent of a neutral phosphorus compound of formula

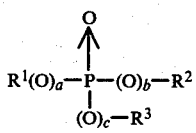

where each of a, b and c, which are the same or different, is 0 or 1, and each of $R^1$, $R^2$ and $R^3$, which are the same or different, is an alkyl, cycloalkyl or alkenyl group, and an acid ester of formula $(R^4O)_2PO(OH)$, where $R^4$ is as defined for $R^1$–$R^3$, and in the presence of nitrate ion to form an organic extract layer containing uranium and an aqueous phosphoric acid layer which are separated.

The crude acid is any aqueous phosphoric acid containing uranium at least some of which is present in the hexavalent state, derived originally from the contact of phosphate rock and a mineral acid e.g. sulphuric acid or less-preferred nitric acid. Thus the crude acid may be that of about 30% $P_2O_5$ concentration formed by the contact of rock and acid and separation of gypsum, or the corresponding acid of about 40–50% $P_2O_5$ concentration formed by contact of rock and acid and separation of hemihydrate. Also the crude acid may be either of these acids after preliminary treatment to reduce the concentration of other impurities such as fluoride, sulphate or iron. The acid may also be one after concentration of such a dilute crude acid e.g. conventional merchant grade acid of 50–57% $P_2O_5$. Particularly important as a source of the crude acid is the aqueous acid obtained as extraction underflow from a solvent purification of a concentrated wet process acid e.g. of merchant grade acid containing 50–55% $P_2O_5$ with a water immiscible organic solvent, such as methylisobutyl ketone (see British Pat. No. 1,436,113) in which the phosphoric acid is extracted into the solvent in preference to the impurities, which become concentrated in the aqueous phase. The crude acid has a $P_2O_5$ content of 35–60% e.g. 35–56% e.g. 40–60% or 40–56%, especially 45–60% or 45–56%, but usually 35–50% e.g. 40–50% and especially 37–45% $P_2O_5$. The crude acid also usually contains 0.1–1.5% Fe, e.g. 0.2–1.2% Fe and especially 0.4–1.0%, and other conventional metallic impurities such as Mg and Al and nonmetallic impurities such as sulphate and fluoride. The uranium content of the crude acid to be extracted may be 0.001–0.1%, e.g. 0.008–0.07% and especially 0.01–0.03% (by weight as U based on the weight of crude acid). The weight percentage of sulphate is usually 0.1–5% (as $SO_4$) e.g. 0.3–3% with a weight ratio of $SO_4$:$P_2O_5$ of 0.001–0.06:1 e.g. 0.002–0.4:1 such as 0.01–0.04:1 and especially 0.02–0.04:1. The total acidity (excluding that from any added Nitric acid are defined as the sum total of phosphoric acid and sulphuric acid contents of the crude acid) is usually 48–85%, e.g. 48–80% e.g. 55–85% or 56–80% especially 63–80% but usually 48–70% e.g. 56–70% and especially 52–63%.

Preferably the crude acid is an underflow from a process for purifying wet process acid by solvent extraction of $H_3PO_4$ and contains 37–50% e.g. 37–45% $P_2O_5$, and 0.01–0.04% U and usually 0.4–1.0% Fe (as Fe111) and 0.3–2% $So_4$; dilution of the underflow with water may be needed to obtain an acid of such concentration.

In the phosphoric acid to be treated, at least some and preferably substantially all the uranium is in the hexavalent state, and all the iron, if present, is in the ferric state. In aged acids containing iron and uranium, the latter is usually already in the hexavalent state, but in fresh acids, the iron is often present as ferrous iron and the uranium in the quadrivalent state. With such acids, it is necessary, before the extraction of uranium, to oxidize the uranium and the iron first to the hexavalent and trivalent states respectively, by oxidizing agents e.g. chlorates such as sodium chlorate, air, hydrogen peroxide or sodium persulphate. This oxidation also helps to remove any organic material which originates from the rock e.g. humic acid, from the phosphoric acid to be treated, though advantageously that acid to be treated is one substantially free of such organic material.

In the neutral phosphorus compound of formula

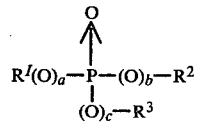

each of a, b and c, which is the same or different, represents 0 or 1, preferably 0, and each of $R^1$, $R^2$ and $R^3$, which is the same or different, represents an alkyl, cycloalkyl or alkenyl group, preferably of 1 to 20 carbon atoms, e.g. 4–12 carbon atoms, and especially 6–10 carbon atoms, e.g. a butyl, amyl, hexyl, octyl, isooctyl, 2-ethyl hexyl, decyl, dodecyl, cyclohexyl or oleyl group. When a, b or c is 1, the group $R^1O$, $R^2O$ or $R^3O$ may represent a residue from a mixture of alcohols of formula $R^1OH$, $R^2OH$ or $R^3OH$, e.g. "oxo" alcohols. Preferably each of $R^1$, $R^2$ and $R^3$ is the same, and especially an alkyl group of 4–12 carbon atoms, primarily n-octyl. When each of a, b and c is 0, the neutral compound is a phosphine oxide, as is preferred, in particular trialkyl phosphine oxides, especially tri octylphosphine oxide. Trialiphatic phosphonates, and phosphinates, may also be used. Furthermore, when a, b and c are all 1, the neutral compounds are phosphate triesters; trialkyl phosphates such as tributyl phosphate are preferred among such esters. In the acid ester of formula $(R^4O)_2PO_2H$, $R^4$ is selected from the same group as $R^1$, $R^2$ and $R^3$. Preferably $R^4$ is an alkyl group of 1–16 carbon atoms, e.g. 4–16 carbon atoms e.g. 2-ethyl hexyl, n-octyl and dodecyl. The acid ester preferably has 8–28 carbon atoms in total. The preferred compounds are dialkyl phosphate esters, especially di (2-ethyl hexyl) phosphate, also known as di (2-ethyl hexyl) phosphoric acid.

While any combination of the neutral phosphorus compound and the acid ester may be used, preferably the combination is that of a triorganophosphine oxide and a diorganophosphate ester, particularly trioctylphosphine oxide and di (2-ethyl hexyl) phosphoric acid.

The acid ester and the neutral phosphorus compound are usually present in the solvent mixture in a molar ratio of 0.2–10:1 e.g. 1:1 to 10:1 e.g. 2:1 to 10:1 such as 2:1 to 6:1 and especially about 4:1. The volume ratio of the solvent mixture and crude acid is usually 1:10 to 10:1 such as 3:1 to 1:3 e.g. about 1:1.

The acid ester and neutral phosphorus compound are dissolved in an inert liquid water immiscible organic solvent such as a hydrocarbon e.g. an aliphatic hydrocarbon of 5–20 e.g. 6–16 and especially 10–14 carbon atoms such as dodecane, heptane, octane, petroleum ether or kerosene, a mixture of aliphatic hydrocarbons of 10–14 carbon atoms, or a chlorinated aliphatic hydrocarbon e.g. of 1–6 carbon atoms and 2–6 chlorine atoms such as dichloromethane or chloroform. Other solvents free of oxygen, nitrogen or phosphorus atoms may also be used. The organic solvent preferably is of low polarity e.g. with a dielectric constant less than 6, and is thus non polar.

The acid ester and neutral compounds, especially phosphine oxide, can each be in 0.01–10 M concentration in the solvent e.g. 0.1–3 M for the acid ester and 0.01–1 M for the neutral compound. Increasing the concentration of acid ester or neutral compound, increases the amount of extraction but at the cost of use of more extractant. Thus while concentrations of acid ester of 1.5–3 M and 0.4–1 M neutral phosphorus compounds may be used, preferably the concentrations are 0.2–1.5 M and 0.05–0.4 M respectively, e.g. 0.3–0.8 M and 0.07–0.2 M respectively, or 0.8–1.5 M and 0.2–0.4 M respectively.

The source of the nitrate ion may be nitric acid or a water soluble nitrate, the cation of which forms no insoluble material, e.g. an insoluble phosphate or sulphate when mixed with the crude acid. Examples of such nitrates are alkali metal or ammonium nitrates or an iron, aluminium or magnesium nitrate, and may be added to the crude acid before or after the latter is mixed with the solvent mixture. The nitrate source may also have been added to a crude phosphoric acid at an earlier stage of purification. It is thus only essential that at the time of separation of the solvent mixture and aqueous acid, there is nitrate ion present; because of the presence of the phosphoric acid there is thus some nitric acid present. Preferably the nitrate source is added to the crude acid before addition of the solvent mixture. The amount of nitrate (expressed as $NO_3^-$) is usually 0.05–10% e.g. 0.2–10% and 0.4–6% or 0.4–4%, especially 0.5–2% based on the weight of crude acid; with the phosphine oxide/acid phosphate ester combination, the amount of nitrate is preferably 0.2–2%, especially 0.3–1.5% e.g. The contact between the solvent mixture and crude acid in the presence of nitrate ion may be in one stage e.g. in a mixture followed by a settler, but better is in more than one countercurrent stage e.g. 2–10 stages or in a column. This multistage extraction is suitable when the amount of extraction in a single stage is small e.g. 40% or less; hence multistage extraction e.g. in 3–7 stages, is suitable when the $P_2O_5$ content of the acid is 40–60% e.g. 40–56% and particularly when the concentration of acid ester in the solvent is less than 1.5 M. The contact between the acid and the solvent mixture is usually carried out at 0°–80° C. e.g. 20°–70° C. and especially 30°–50° C. and preferably for a time in the range 1 minute to 60 minutes. Thus in a preferred process a crude acid of 37–45% e.g. 40–45% $P_2O_5$ content is contacted with a solution in an aliphatic hydrocarbon containing 0.2–1.5 M bis (2-ethyl hexyl) phosphate and 0.05–1 e.g. 0.05–0.5 M trioctyl phosphine oxide in the presence of 0.3–1.5% by weight of nitrate ion, and preferably in 2–7 counter current stages. In another preferred process, a crude acid of 40–60%, e.g. 40–56% or 45–60% $P_2O_5$ is contacted with a solution in an aliphatic hydrocarbon containing 0.8–4 M e.g. 0.8–2.5 M bis (2-ethylhexyl) phosphate and 0.1–2 M e.g. 0.2–0.6 M tri octyl phosphine. Oxide in the presence of 0.4–6% e.g. 0.5–1.5% by weight of nitrate ion and preferably 2–7 counter current stages. The contact gives an organic extract layer containing uranium and the two solvents, and an aqueous acid layer of reduced uranium content. The two layers are separated and the uranium recovered as a uranium compound from the organic layer, preferably eventually being produced as uranyl oxide. Preferably the uranium is recovered by reduction to the tetravalent state e.g. with ferrous iron and release into an aqueous phase e.g. of aqueous phosphoric acid. Such recovery processes from organic extracts of uranium in D2EHPA/TOPO mixtures in hydrocarbon solvents are described in Chemical Engineering, Jan. 3, 1977, pages 56–7 by F. J. Hurst, W. D. Arnold and A. D. Ryon, and in earlier papers by Hurst. Thus preferably the organic extract layer is washed with an aqueous phosphoric acid containing ferrous iron (which may be under an inert or reducing atmosphere) to give an organic layer for recycle and an aqueous acid layer containing uranium, which layers are separated. This acid layer is preferably re-used to strip further uranium containing organic layer, and the stripping process repeated. By this means, the uranium content of the acid can be increased until it is high enough to warrant treatment with an extractant in a diluent e.g. a mixture of a diorganophosphate and a neutral phosphorus compound as defined above such as D2EHPA and TOPO to form an organic extract containing U and an aqueous acid, which are separated. The organic extract is then treated with a precipitating reagent such as ammonium carbonate to deposit a uranium containing yellow cake, which after filtration and calcination gives uranium oxide. Alternatively, instead of the reductive stripping of the original organic extract layers, the uranium may be recovered by stripping with an aqueous base directly, or with aqueous hydrogen fluoride to form uranium tetrafluoride.

If the crude acid treated for recovery of uranium contains any polar water immiscible or miscible solvents such as alcohols or ketones, these are preferably removed from the recycle solvent before contact of the solvent with fresh acid, in order to avoid build-up of polar solvent in the solvent mixture.

The invention is illustrated in the following Examples.

EXAMPLES 1–4 AND COMPARATIVE EXAMPLES A–C

In these a solution in petroleum ether (boiling point 100°–140° C.) of a mixture of trioctyl phosphine oxide and di-2-ethylhexyl phosphoric acid in a 1:4 molar ratio was mixed at 40° C. with a crude aqueous phosphoric acid in a 1:1 solution:acid volume ratio. A concentrated acid containing 55.1% $P_2O_5$, 0.03% (as U V1), 1.5% $SO_4$, 0.6% Fe (as Fe111), 0.2% Al, other metallic impurities and about 200 ppm methyl isobutyl ketone, was obtained from the underflow from the purification of wet process acid with methyl isobutyl ketone according to BP 1436113. The crude acids used in these Examples were made by dilution of the concentrated acid with distilled water. To each crude acid, as indicated, was added 70% aqueous nitric acid before mixing with the petroleum ether solution.

The extract layer and acid layer obtained by the mixing were separated and weighed and the acid layer analyzed for U to determine the amount of extraction of U. Also given are details of the corresponding experiments without the added nitric acid (comparative Examples A–C).

The U was recovered from each extract by washing the extract layer with aqueous phosphoric acid containing 30% $P_2O_5$ and 1.3% $Fe^{2+}$ to give a solvent layer for recycle and an aqueous layer containing uranium. The layers were separated.

EXAMPLES 1, 2 AND COMPARATIVE EXAMPLES A, B

The petroleum ether solution contained di (2-ethyl hexyl) phosphoric acid in 0.75 M concentration and trioctyl phosphine oxide in 0.19 M concentration. The results were as given in Table 1.

TABLE 1

| Example | % $P_2O_5$ in crude acid | Conc. of U in crude acid, ppm | Weight % nitrate in crude acid | % U extracted |
|---|---|---|---|---|
| I | 42.6 | 209 | 0.4 | 49 |
| Comp. A | 42.6 | 209 | 0 | 41 |
| 2 | 47.4 | 232 | 0.4 | 34 |
| Comp. B | 47.4 | 232 | 0 | 21 |

EXAMPLE 3 AND COMPARATIVE EXAMPLE C

The petroleum ether solution contained di(2-ethyl hexyl) phosphoric acid in 1.0 M concentration and trioctyl phosphine oxide in 0.25 M concentration. This solution contacted a wet process phosphoric acid containing 41.1% $P_2O_5$ in the presence of 0.5% nitric acid and in the absence of the nitric acid. The degree of extraction of U was 65% in the presence of the nitrate and 55% in its absence.

EXAMPLE 4

The petroleum ether solution used in Example 3 was contacted with a wet process phosphoric acid containing 42.6% $P_2O_5$ and 216 ppm U with added nitric acid to make a 0.1 M solution i.e. containing 0.4% nitric acid. The contact was in 4 countercurrent stages through 4 pairs of mixers/settlers. 79% of the U in the wet process acid was extracted.

EXAMPLES 5–20 AND COMPARATIVE EX D–P

The method used in Ex 1–4 was repeated with mixtures of TOPO and D2EHPA in the same molar ratio (1:4) as before but in varying concentrations in the petroleum ether solutions and with different crude aqueous phosphoric acids. The crude acid:petroleum ether solution volume ratio was 1:1. The concentrated acid, which was diluted if and as necessary with water, contained 55.7% $P_2O_5$, 1.61% $SO_4$, 0.03% U V1 0.32% Fe, 0.68% Mg 0.23% Al and 1.12% F as well as other metallic impurities and about 200 ppm methyl isobutyl ketones and was obtained from the underflow as in Ex 1–4. The nitrate was added as 70% by weight aqueous nitric acid.

In each case the organic extract and acid layer obtained on mixing the crude acid and petroleum ether solution were separated, weighed and each layer analysed for U. The petroleum ether solution was worked up to release the uranium as in Ex 1–4.

In Examples 5–8 and Comparative Examples D–G, the aqueous phosphoric acids were extracted with a petroleum ether solution containing 0.5 M D2EHPA and 0.125 M TOPO. The results were given in Table 2.

TABLE 2

| Example | % (wt) $P_2O_5$ in crude acid | % (wt) $NO_3$ in crude acid /% | U in acid after extraction /ppm | U in Organic after extraction /ppm | Extraction Efficiency /% |
|---|---|---|---|---|---|
| D | 43.7 | — | 164 | 111 | 27 |
| 5 | 43.7 | 1.0 | 122 | 181 | 46 |
| E | 47.5 | — | 178 | 79 | 19 |
| 6 | 47.5 | 1.0 | 157 | 149 | 33 |
| F | 50.8 | — | 237 | 54 | 10 |
| 7 | 50.8 | 1.0 | 188 | 138 | 27 |
| G | 55.7 | — | 254 | 76 | 5 |
| 8 | 55.7 | 1.0 | 227 | 117 | 20 |

TABLE 3

| Example | % (wt) $P_2O_5$ | % (wt) $NO_3$ in crude acid | U in acid after Extraction /ppm | U in Organic after Extraction /ppm | Extraction Efficiency /% |
|---|---|---|---|---|---|
| H | 43.7 | — | 112 | 213 | 52 |
| 9 | 43.7 | 1.0 | 81 | 268 | 65 |
| J | 47.5 | — | 153 | 164 | 38 |
| 10 | 47.5 | 1.0 | 104 | 246 | 57 |
| K | 50.8 | — | 208 | 103 | 21 |
| 11 | 50.8 | 1.0 | 149 | 220 | 44 |
| L | 55.7 | — | 271 | 53 | 10 |
| 12 | 55.7 | 1.0 | 188 | 199 | 36 |

TABLE 4

| | | | | | |
|---|---|---|---|---|---|
| M | 43.7 | — | 69 | 217 | 68 |
| 13 | 43.7 | 1.0 | 53 | 271 | 78 |
| N | 55.7 | — | 229 | 92 | 21 |
| 14 | 55.7 | 1.0 | 166 | 192 | 42 |

In Examples 9–12 and Comparative Examples H–L, the crude phosphoric acids were extracted with a petroleum ether solution containing 1.0 M D2EHPA and 0.25 M TOPO. The results were as given in Table 3.

In Examples 13, 14 and Comparative Examples M, N, the crude phosphoric acids were extracted with a petroleum ether solution containing 2.0 M D2EHPA and 0.5 M TOPO. The results were as given in Table 4.

I claim:

1. A process for extracting uranium from a wet process phosphoric acid containing uranium, which process comprises contacting said phosphoric acid, which contains 35–60% by weight of $P_2O_5$ and uranium at least some of which is in the hexavalent state, with a solution in an inert non polar water immiscible organic solvent of a neutral phosphorus compound of formula

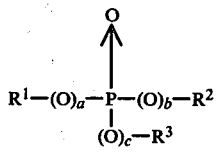

where each of a, b and c, which are the same or different, is 0 or 1, and each of $R^1$, $R^2$ and $R^3$, which are the same or different, is an alkyl, cycloalkyl or alkenyl group, and an acid ester of formula $(R^4O)_2PO(OH)$, where $R^4$ is as defined for $R^1$–$R^3$, and wherein said phosphoric acid containing uranium contains nitrate ion in an amount between 0.05 and 10% to form an organic extract phase containing uranium and an aqueous phosphoric acid, which are separated.

2. The process of claim 1 wherein said phosphoric acid containing uranium contains 40–56% by weight of $P_2O_5$.

3. The process of claim 1 wherein said phosphoric acid containing uranium contains 37–45% by weight of $P_2O_5$.

4. The process of claim 3 wherein the nitrate content of said phosphoric acid containing uranium is 0.3–1.5%.

5. The process of claim 1, or 2 or 3 wherein the concentration of the acid ester in the solvent is 0.2–1.5 M.

6. The process of claim 1, or 2 or 3 wherein the concentration of neutral phosphorus compound in the solvent is 0.05–1 M.

7. The process of claim 1, or 2 or 3 wherein the neutral phosphorus compound is a trialkyl phosphine oxide with 4–12 carbon atoms in each alkyl group.

8. The process of claim 7 wherein the neutral compound is trioctyl phosphine oxide.

9. The process of claim 1, or 2 or 3 wherein the acid ester is a dialkyl phosphate with 4–12 carbon atoms in each alkyl group.

10. The process of claim 9 wherein the acid ester is bis (2-ethyl hexyl) phosphate.

11. The process of claim 1, or 2 or 3 wherein said phosphoric acid containing uranium is contacted with said solution in 2–7 countercurrent stages.

12. The process of claim 11 wherein said phosphoric acid contains 40–50% by weight of $P_2O_5$.

13. The process of claim 2 or 3 wherein said phosphoric acid is treated with a solution in said solvent of trioctyl phosphine oxide and bis (2-ethyl hexyl) phosphate.

14. The process of claim 11 wherein said phosphoric acid is treated with a solution in said solvent of trioctyl phosphine oxide and bis (2-ethyl hexyl) phosphate.

15. The process of claim 14 wherein said phosphoric acid is a crude wet process phosphoric acid containing uranium.

16. The process of claim 1 or 2 or 3 or 4 wherein said phosphoric acid is a crude wet process phosphoric acid containing uranium.

17. The process of claim 12 wherein said phosphoric acid is a crude wet process phosphoric acid containing uranium.

18. The process of claim 14 wherein a phosphoric acid of 40–56% $P_2O_5$ content containing uranium is contacted with a solution in an aliphatic hydrocarbon containing 0.2–1.5 M bis (2-ethyl hexyl) phosphate and 0.05–1 M trioctyl phosphine oxide in the presence of 0.3–1.5% by weight of nitrate ion and wherein said phosphoric acid containing uranium is contacted with said solution in 2–7 countercurrent stages.

19. The process of claim 1, or 4 or 18 wherein the organic extract phase containing uranium is treated to recover the uranium as uranyl oxide.

* * * * *